US010165874B2

(12) United States Patent
Bacallao

(10) Patent No.: US 10,165,874 B2
(45) Date of Patent: Jan. 1, 2019

(54) BAGGING STATION BAGGING CLIP

(71) Applicant: Walmart Apollo, LLC, Bentonville, AR (US)

(72) Inventor: Yurgis Mauro Bacallao, Centerton, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/472,658

(22) Filed: Mar. 29, 2017

(65) Prior Publication Data

US 2017/0280900 A1 Oct. 5, 2017

Related U.S. Application Data

(63) Continuation-in-part of application No. 29/560,807, filed on Apr. 11, 2016, now Pat. No. Des. 795,061.

(60) Provisional application No. 62/435,222, filed on Dec. 16, 2016, provisional application No. 62/340,642, filed on May 24, 2016, provisional application No. 62/315,222, filed on Mar. 30, 2016.

(51) Int. Cl.

| | |
|---|---|
| ***A47F 13/00*** | (2006.01) |
| ***A47F 9/04*** | (2006.01) |
| ***B65B 67/12*** | (2006.01) |

(52) U.S. Cl.

CPC ..... *A47F 9/042* (2013.01); *B65B 67/1227* (2013.01); *B65B 67/1233* (2013.01); *B65B 67/1266* (2013.01); *B65B 2067/1294* (2013.01)

(58) Field of Classification Search

CPC ..... A47F 13/085; B65D 33/001; B65B 43/14; B65B 67/1266; Y10T 24/155

See application file for complete search history.

(56) References Cited

U.S. PATENT DOCUMENTS

| | | | |
|---|---|---|---|
| 1,452,492 | A | 4/1923 | Carpenter |
| 2,026,454 | A | 12/1935 | Hugo |
| 2,204,117 | A | 6/1940 | Harry |

(Continued)

FOREIGN PATENT DOCUMENTS

| | | |
|---|---|---|
| EP | 1138601 A1 | 10/2001 |
| GB | 2361740 | 10/2001 |

OTHER PUBLICATIONS

Search Report in UK Patent Application No. GB1704784.6, dated Sep. 29, 2017; 3 pages.

(Continued)

*Primary Examiner* — Bradley Duckworth

(74) *Attorney, Agent, or Firm* — Schmeiser, Olsen & Watts LLP

(57) ABSTRACT

Disclosed is a bagging clip that couples to a bag holder hook of a shopping bag bagging station. The bagging clip helps to keep shopping bags hung from the bag holder hook in place as one of the shopping bags is opened, filled and removed. The bagging clip includes a plate with at least one slot in the plate. The slot is a cutout in the plate extending from a front surface to a back surface of the plate. The slot is configured to couple with a rail of the bag holder hook of the bag holder, in order to couple the bagging clip to the bag holder hook. Once the bagging clip is coupled to the bag holder hook, shopping bags hung from the bag holder hook will stay in place as individual shopping bags are filled and removed from the bag holder hook.

10 Claims, 12 Drawing Sheets

(56) References Cited

U.S. PATENT DOCUMENTS

| | | | | |
|---|---|---|---|---|
| 3,361,294 | A * | 1/1968 | Bjerum | A47F 13/085 206/526 |
| D217,903 | S | 6/1970 | Derenski | |
| 4,516,384 | A | 5/1985 | Imperiale | |
| 4,819,898 | A * | 4/1989 | Benoit | B65B 43/14 248/97 |
| 4,952,093 | A | 8/1990 | Murakami | |
| 4,974,764 | A | 12/1990 | Cantwell | |
| 5,118,022 | A * | 6/1992 | Farahnik | A47F 13/085 225/106 |
| 5,213,145 | A * | 5/1993 | Huang | A47F 13/085 141/314 |
| D347,171 | S | 5/1994 | Specht et al. | |
| 5,323,909 | A * | 6/1994 | Piraneo | B65B 67/1227 206/554 |
| 5,340,634 | A | 8/1994 | Adams | |
| D356,261 | S | 3/1995 | Miceli, Jr. | |
| 5,465,845 | A | 11/1995 | Norby et al. | |
| D373,070 | S | 8/1996 | Kriegstein | |
| 5,797,166 | A | 8/1998 | Wagenheim | |
| D414,537 | S | 9/1999 | Crate | |
| 6,179,126 | B1 | 1/2001 | Smithson et al. | |
| 6,382,429 | B1 * | 5/2002 | Yeh | A47F 9/042 206/554 |
| 6,389,652 | B1 * | 5/2002 | Williams | B65D 33/1625 24/129 B |
| 6,508,381 | B1 | 1/2003 | Sadi | |
| D503,095 | S | 3/2005 | Burr et al. | |
| D514,431 | S | 2/2006 | Tanaka et al. | |
| D540,153 | S | 4/2007 | Tanaka et al. | |
| D544,792 | S | 6/2007 | Camarella | |
| D549,073 | S | 8/2007 | Gilbert et al. | |
| 7,275,657 | B2 | 10/2007 | Geyer | |
| 7,387,324 | B1 | 6/2008 | Sharpe | |
| D592,508 | S | 5/2009 | Perignon | |
| D593,411 | S | 6/2009 | Bizzell | |
| D595,130 | S | 6/2009 | Bizzell | |
| D597,828 | S | 8/2009 | Tanaka | |
| D601,420 | S | 10/2009 | Miceli, Jr. | |
| D623,500 | S | 9/2010 | Langner et al. | |
| 7,926,149 | B2 | 4/2011 | Weston | |
| 7,980,411 | B2 * | 7/2011 | Kasbohm | B65F 1/06 220/495.08 |
| 8,028,873 | B2 | 10/2011 | Hawk et al. | |
| 8,196,873 | B2 * | 6/2012 | Kohn | A47F 9/042 248/100 |
| 8,261,460 | B2 | 9/2012 | Essel | |
| 8,568,190 | B2 * | 10/2013 | Nelson | A63H 27/10 24/129 R |
| 9,078,534 | B2 * | 7/2015 | Manasharov | B66F 19/00 |
| D752,867 | S | 4/2016 | Morszeck | |
| D795,061 | S | 8/2017 | Bacallao | |
| 2002/0078534 | A1 | 6/2002 | Williams | |
| 2004/0051331 | A1 | 3/2004 | Freedlund | |
| 2004/0159756 | A1 | 8/2004 | Albertson | |
| 2005/0045685 | A1 | 3/2005 | Sesto | |
| 2007/0113453 | A1 * | 5/2007 | Dickinson | A47F 13/085 40/673 |
| 2008/0197245 | A1 * | 8/2008 | Weldon | A47F 13/085 248/95 |
| 2010/0067831 | A1 * | 3/2010 | Alvarado | A47F 13/085 383/37 |
| 2013/0223766 | A1 | 8/2013 | Gebhardt | |
| 2014/0216962 | A1 | 8/2014 | Higdon et al. | |

OTHER PUBLICATIONS

Notice of Allowance in Design U.S. Appl. No. 26/560,807, dated May 9, 2017; 10 pages.

"Single Pronged Display Hook Security," Stacey-Europe.com, accessed Oct. 27, 2016.

"2X Power Plug Socket Jack Hook Rack Holder Hanger Home Wall Decor Organizer", Aliexpress.com, accessed on Apr. 14, 2016; 13 pages.

"Closetmaid Superslide J Bracket Support WHI", Masters Home Improvement, accessed on Apr. 14, 2016; 4 pages.

"1pc New Design Cartoon Animal Bear/Cat/Frog Kitchen Suction Racks Home Supplies", Aliexpress.com, accessed on Apr. 14, 2016; 8 pages.

"1 X Cargo Trunk Bag Hook Kit for VW Passat CC B6 Jetta Audi A4 S4", Amazon.com, accessed on Apr. 14, 2016; 6 pages.

Internet Image, https://s-media-cache-ak0.pinimg.com/236x/d4/85/9c/d4859cecfa5b23d54739860212d9b1eb.jpg, accessed on Apr. 14, 2016; 1 page.

International Search Report and Written Opinion for PCT Application No. PCT/US2017/064593, dated Feb. 16, 2018.

* cited by examiner

BAGGING STATION BAGGING CLIP

CROSS REFERENCE TO RELATED APPLICATION

This invention claims priority to U.S. provisional patent application Ser. No. 62/435,222, filed Dec. 16, 2016 to Applicant Wal-Mart Stores Inc., and entitled "Bagging Station Bagging Clip"; to U.S. provisional patent application Ser. No. 62/315,222, filed Mar. 30, 2016 to Applicant Wal-Mart Stores Inc., and entitled "Bagging Station Bagging Clip"; to U.S. provisional patent application Ser. No. 62/340,642, filed May 24, 2016 to Applicant Wal-Mart Stores Inc., and entitled "Bagging Station Bagging Clip", and is a Continuation-in-Part application of U.S. design patent application Ser. No. 29/560,807, filed Apr. 11, 2016 to Applicant Wal-Mart Stores Inc., and entitled "Bagging Station Bagging Clip"; all of which are incorporated entirely herein by reference.

BACKGROUND OF THE INVENTION

Technical Field

This invention relates to bagging stations used in retail stores, and more specifically, to a bagging clip used at a bagging station to hold shopping bags on a bag holder hook of a shopping bag holder.

State of the Art

A bagging station is a fixture located in a retail store that includes a bag holder. Bagging stations include bag holders that dispense shopping bags. A bag holder holds a stack of shopping bags, and dispenses these bags as they are filled with products a customer has purchased. The shopping bags are held by the bag holder in a manner and position such that it is easy and convenient for a person to open one bag at a time, place purchased items in the bag, and then remove the bag and the enclosed products from the bag holder. Shopping bags are slid onto a bag holder hook of the bag holder in a stack, and are pulled open one at a time from the bag holder hook. The problem is, when one bag is pulled open or off of the bag holder hook, one or more additional bags often fall off or are pulled off of the bag holder hook and need to be replaced. It takes time and effort for employees and customers to constantly replace the stack of shopping bags on the bag holder hook after they have inadvertently fallen off or slid off. Rubber bands or tape are often used on the bag holder hook to try to hold the stack of shopping bags on the bag holder hook, but these fixes are temporary and ineffective.

Accordingly, what is needed is a device that holds the stack of shopping bags on the bag holder hook, allowing one bag to be opened and/or removed from the bag holder hook while retaining the remainder of the stack of shopping bags on the bag holder hook.

DETAILED DESCRIPTION OF EMBODIMENTS OF THE INVENTION

As discussed above, embodiments of the present invention relate to bagging stations used in retail stores, and more specifically to a bagging clip used to hold shopping bags on a bag holder hook of a shopping bag holder. Disclosed is a shopping bag bagging station that includes a bagging clip. The bagging station includes at least one bag holder with a bag holder hook. The disclosed bagging clip couples to the bag holder hook of the bag holder. The bagging clip helps to keep shopping bags hung from the bag holder hook in place as one of the shopping bags is opened, filled, and then removed from the bag holder. The bagging clip includes a plate, which can be any shape including a round disk, with at least one slot in the plate. The slot is a cutout in the plate, with the cutout extending all the way through the plate from a front surface of the plate to a back surface of the plate. The slot is configured to couple to a rail of the bag holder hook of the bag holder, which couples the bagging clip to the bag holder hook. Once the bagging clip is coupled to the bag holder hook, shopping bags hung from the bag holder hook will stay in place as individual shopping bags are filled and removed from the bag holder hook.

The bagging clip saves employees and customers time, because they no longer have to replace shopping bags that have inadvertently fallen off the bag holder hook when another shopping bag is removed. The bagging clip also has a strap hole for coupling a strap, cord, or wire to the bagging clip. The strap, cord, or wire is used to couple the bagging clip to the bag holder or the bagging station, so the bagging clip does not get lost or separated from the bag holder.

Disclosed is a bagging clip for a shopping bag bagging station that includes a disk, and a means to couple the disk to a bag holder hook of a shopping bag holder. Once the disk is coupled to the bag holder hook, the bagging clip holds a plurality of shopping bags on the bag holder hook, keeping the plurality of shopping bags from sliding off or falling off of the bag holder hook as individual shopping bags are filled or removed from the bag holder hook. In some embodiments, the means to couple the disk to the bag holder hook includes a means to couple the disk to a first rail of the bag holder hook, and a means to couple the disk to a second rail of the bag holder hook.

Figure 1:
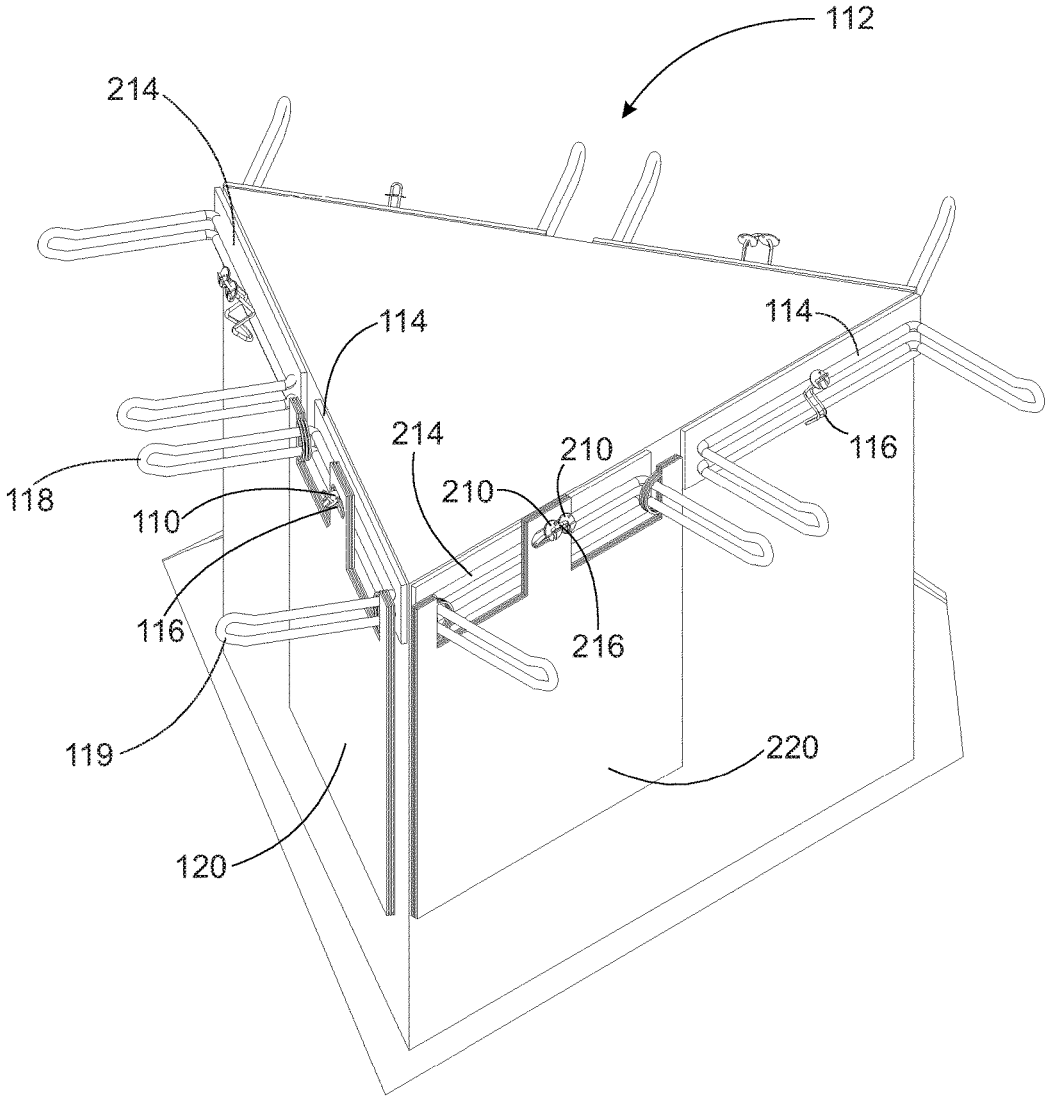
FIG. 1 show a perspective view of a bagging station with a number of bag holders, where each bag holder has a bagging clip coupled to a bag holder hook of the bag holder.

FIG. 1 shows a front perspective view of a shopping bag bagging station 112 that includes shopping bag holders 114 and 214, and bagging clips 110 and 210. Bagging clip 110 is coupled to shopping bag holder 114 of bagging station 112. Bagging clip 110 is used to keep a plurality of shopping bags 120 hanging from a bag holder hook 116 of shopping bag holder 114 when individual shopping bags are removed from bag holder hook 116. When one of plurality of shopping bags 120 is opened, filled, and/or removed from bag holder hook 116, bagging clip 110 keeps the remainder of plurality of shopping bags 120 hanging from bag holder hook 116.

Bagging clip 210 is coupled to shopping bag holder 214 of bagging station 112. Bagging clip 210 is used to keep a plurality of shopping bags 220 hanging from a bag holder hook 216 while one of plurality of shopping bags 220 is opened, filled, and/or removed from bag holder hook 216.

Figure 9:
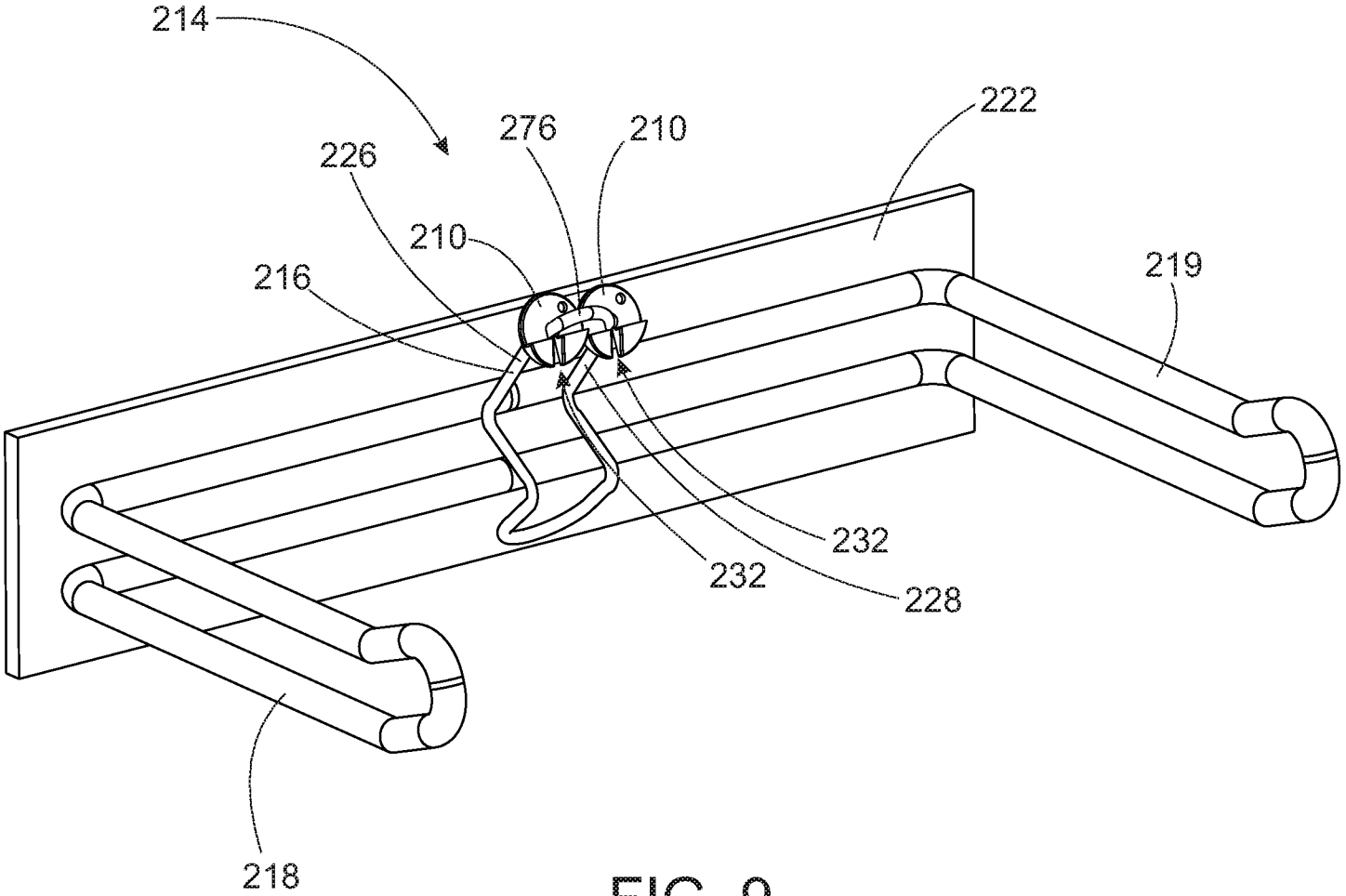
FIG. 9 shows a perspective view of a further embodiment of a bag holder, with a further embodiment of a bagging clip coupled to a bag holder hook of the bag holder.

Bagging clip 110 and 210 are both means to keep a plurality of shopping bags from falling off a bag holder hook of a shopping bag holder, but they are designed for different types of bag holder hooks, as shown and described herein. Bagging clip 110 (FIG. 1 and FIG. 3 through FIG. 7) is designed for use with a bag holder hook 116, which has two parallel rails (or rods or bars) that are fairly close together (about $1/16^{th}$ inch apart in the embodiment shown). Bagging clip 210 (FIG. 1 and FIG. 9 through FIG. 13) is for use with a bag holder hook 216, which has two parallel rails farther apart (about 1 inch apart in the embodiment shown). Two bagging clips 210 are used on bag holder hook 216, as shown in FIG. 1 and FIG. 9, with one bagging clip 210 on each rail.

Bagging station 112 is located in a retail store, often at a checkout register, or wherever items purchased are bagged by cashiers, employees, or customers. Bagging station 112 includes at least one bag holder 114 or 214. Bagging station 112 is shown in FIG. 1 with at least one bag holder 114 and at least one bag holder 214 attached to bagging station 112. It is to be understood that bagging station 112 can have either or both types of bag holders 114 and 214 attached to bagging station 112. In some embodiments, bagging station 112 has only bag holders 114. In some embodiments, bagging station 112 has only bag holders 214. In some embodiments, bagging station 112 can have different types of bag holders that use bagging clips 110 or 210.

Figure 2:
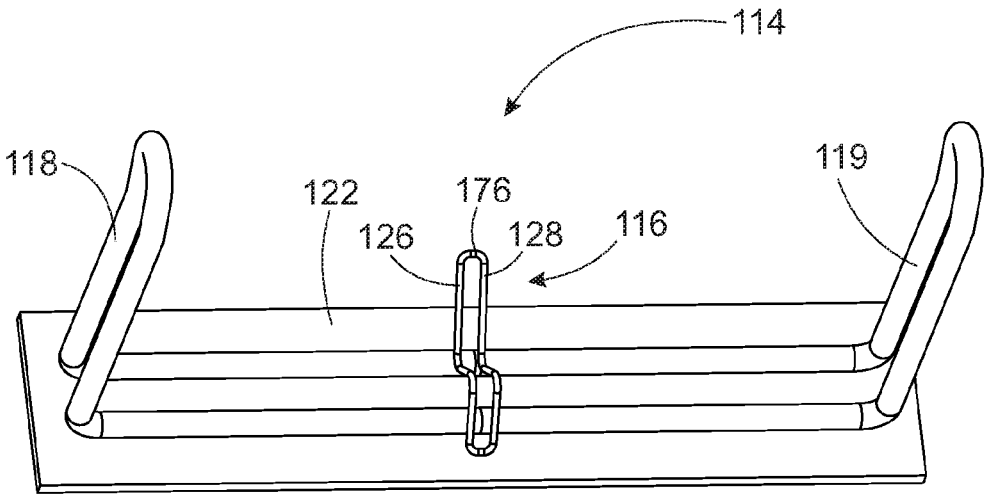
FIG. 2 shows a bag holder of a bagging station.
Figure 3:
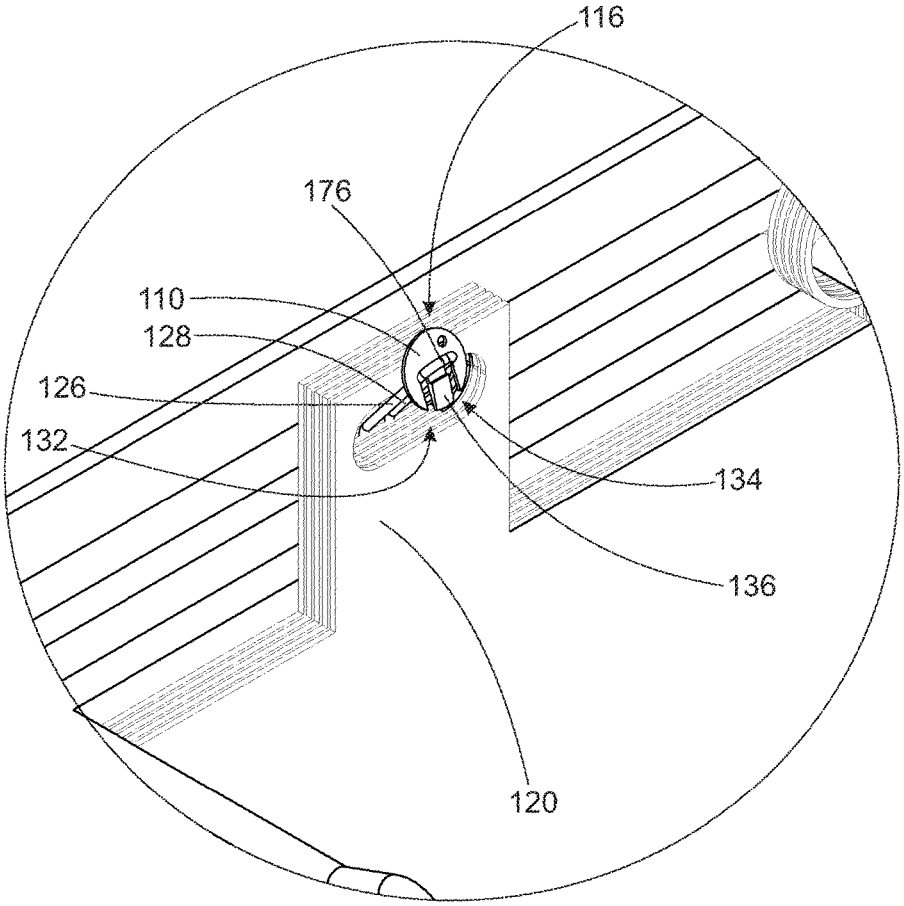
FIG. 3 shows a close-up view of a bag holder hook of a bag holder, with a plurality of shopping bags and a bagging clip coupled to the bag holder hook.

FIG. 2 shows a front perspective view of an embodiment of bag holder 114. Bag holder 114, shown in FIG. 2 without shopping bags hanging from it, is used to hold a plurality of shopping bags 120 at bagging station 112. Bag holder 114 can take many different forms. Bag holder 114, in this embodiment, includes a support bar 122, a first handle holder arm 118 and a second handle holder arm 119 coupled to and extending from support bar 122, and a bag holder hook 116 coupled to and extending from support bar 122, as shown in FIG. 2. Bag holder hook 116 extends from support bar 122 between first handle holder arm 118 and second handle holder arm 119. In this embodiment of bag holder 114, plurality of shopping bags 120 are hung on bag holder hook 116, with the arms of plurality of shopping bags 120 hung on each of handle holder arms 118 and 119, as shown in FIG. 1. Bag holder hook 116 includes two adjacent rails 126 and 128, as shown in FIG. 2 and FIG. 3. Bag holder 114 is a part of bagging station 112 as shown in FIG. 1. Bag holder 114 is the part of bagging station 112 that dispenses plurality of shopping bags 120. Bag holder 114 can take many different forms, but each bag holder 114 has a bag holder hook 116 that holds plurality of shopping bags 120. Bag holder 214 is similar to bag holder 114 except that bag holder 214 has a bag holder hook 216 instead of a bag holder hook 116. Bag holder hook 216 has more distance between adjacent rails, as shown in FIG. 9. Bagging clip 110 will not work on bag holder hook 216 because the adjacent rails of bag holder 214 are too far apart.

FIG. 3 shows a close-up front perspective view of bag holder hook 116 holding plurality of shopping bags 120, with bagging clip 110 coupled to bag holder hook 116. Bagging clip 110 keeps plurality of shopping bags 120 from sliding off or falling off of bag holder hook 116 as an individual one of plurality of shopping bags 120 is opened, filled, or removed from bag holder hook 116. Bagging clip 110 allows one at a time of plurality of shopping bags 120 to be opened and removed, while keeping the remaining shopping bags hanging from bag holder hook 116.

Figure 4:
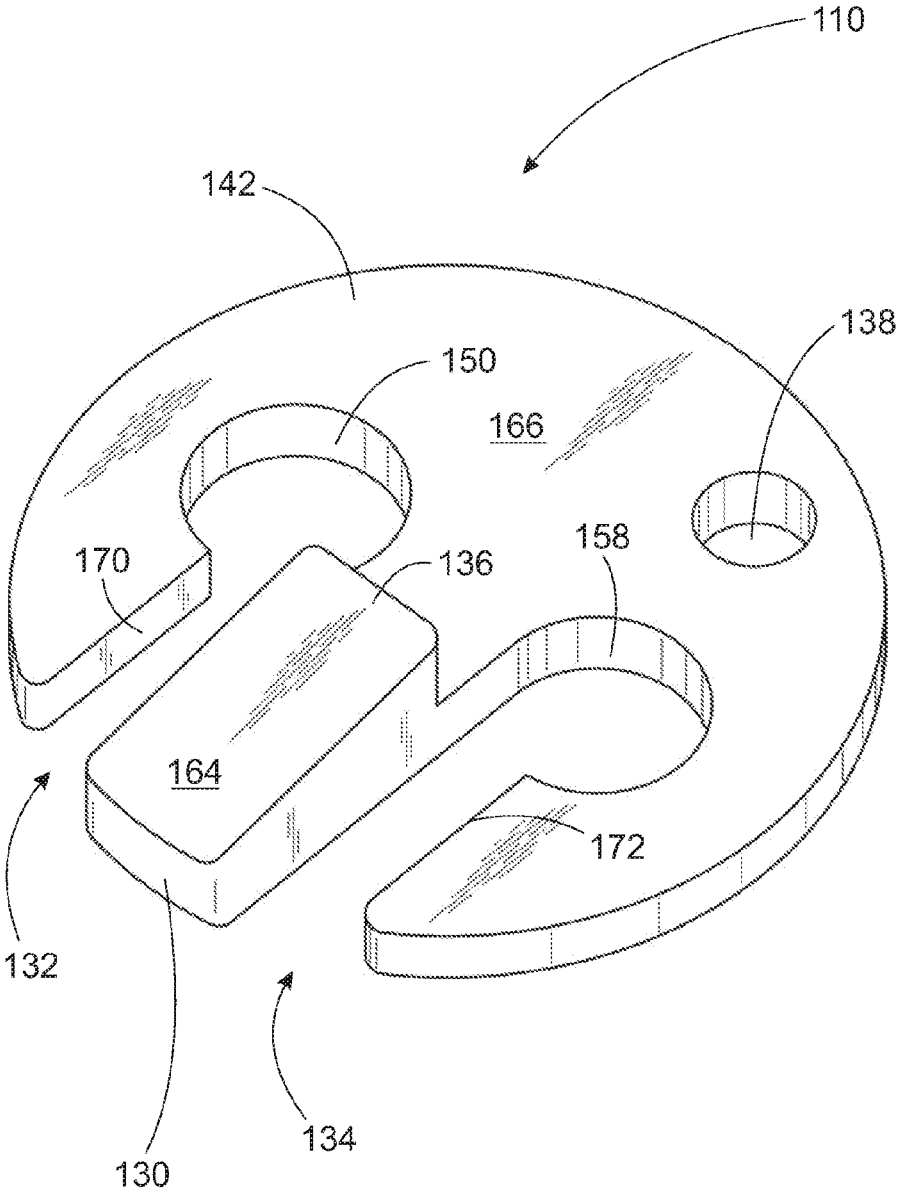
FIG. 4 shows a front perspective view of a bagging clip.
Figure 5:
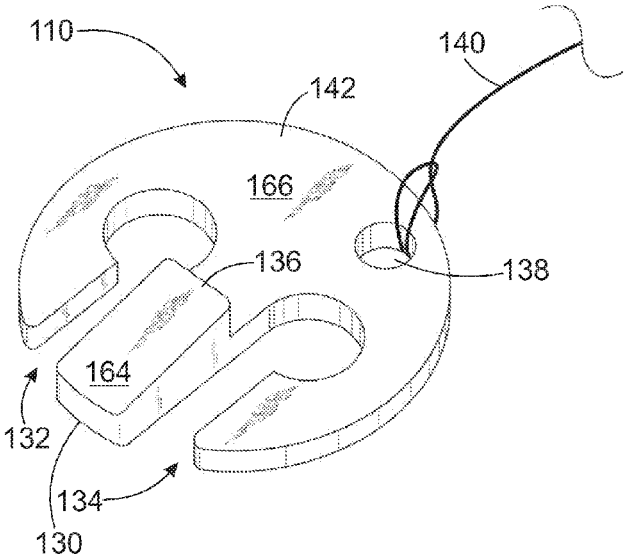
FIG. 5 shows a front perspective view of the bagging clip of FIG. 4.
Figure 6:
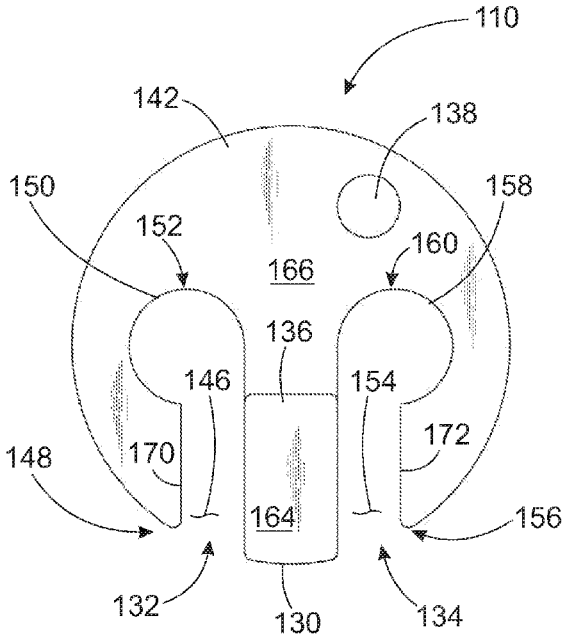
FIG. 6 shows a front view of the bagging clip of FIG. 4.
Figure 7:
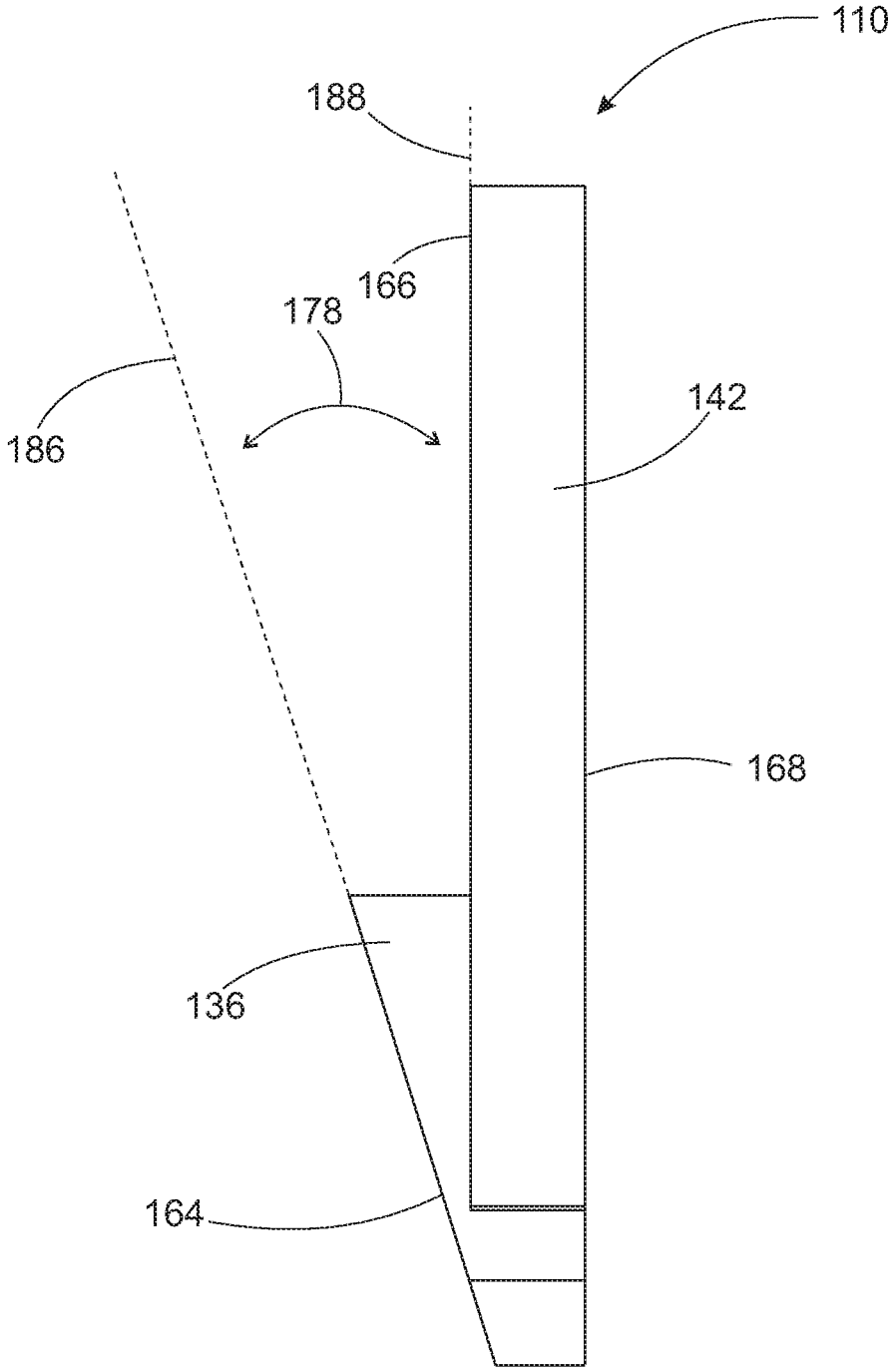
FIG. 7 shows a side view of the bagging clip of FIG. 4.

FIG. 4 through FIG. 7 show additional details of bagging clip 110. FIG. 4 shows a front perspective view of bagging clip 110. FIG. 5 shows bagging clip 110 with a strap 140 coupled to a strap hole 138. FIG. 6 shows a front view of bagging clip 110. FIG. 7 shows a side view of bagging clip 110.

Bagging clip 110 is formed of a plate, which in this embodiment is in the shape of a disk 142. It is to be understood that the plate forming bagging clip 110 can be many other shapes and configurations other than a disk, such as a square, rectangular, triangular, or oval shape, for example, but not meant to be limiting. Disk 142 includes at least one slot in the plate, which in this embodiment includes first slot 132 and second slot 134 in disk 142. Slots 132 and 134 couple disk 142 to a rail of bag holder hook 116. First slot 132 and second slot 134, in this embodiment, are the means to couple disk 142 to bag holder hook 116 of shopping bag holder 114. Each of first and second slot 132 and 134 couple to a rail of bag holder hook 116 of shopping bag holder 114.

Bag holder hook 116, in the embodiment shown in FIG. 1 through FIG. 3, is formed in part of a number of metal rails, which includes a first rail 126 and a second rail 128 (see FIG. 2 and FIG. 3). First rail 126 and second rail 128 are about $1/16^{th}$ inch apart in this embodiment, but this is not meant to be limiting. First rail 126 and second rail 128 are parallel to each other in this embodiment, and are coupled together at an end 176 of bag holder hook 116. In this embodiment, first slot 132 is a means to couple disk 142 of bagging clip 110 to first rail 126 of bag holder hook 116, and second slot 134 is a means to couple disk 142 of bagging clip 110 to second rail 128 of bag holder hook 116, as shown in FIG. 3. The use of two slots, first slot 132 and second slot 134, ensures that bagging clip 110 couples securely to bag holder hook 116 and does not fall off of bag holder hook 116. It is to be understood that bag holder hook 116 can take many other forms, and the means to couple disk 142 of bagging clip 110 to bag holder hook 116 can take many different forms other than first and second slots 132 and 134. In some embodiments, a bagging clip includes only one slot that couples the bagging clip to the bag holder hook, see, for example, bagging clip 210 shown and described in FIG. 9 through FIG. 13.

Referring back to FIG. 4 through FIG. 7, first and second slot 132 and 134 are each cutouts in disk 142. The cutouts extend all the way through disk 142, from a disk front surface 166 to a disk back surface 168 (see FIG. 4 and FIG. 7) of disk 142. First slot 132 and second slot 134 are approximately parallel to each other in the embodiment of bagging clip 110 shown in the figures (see FIG. 6), but this is not meant to be limiting. In some embodiments, first slot 132 and second slot 134 are not parallel to each other.

Center support 130 is between first slot 132 and second slot 134. Center support 130 is less than about 1/16" wide, in this embodiment, because first slot 132 and second slot 134 are equal to or less than about 1/16" apart. First slot 132 and second slot 134 are equal to or less than about 1/16" apart because first rail 126 and second rail 128 are about 1/16" apart in this embodiment. It is to be understood that the width of center support 130 and the distance between first and second slot 132 and 134 is different in some embodiments to accommodate different sizes of bag holder hooks 116 with different sizes of bagging clips 110.

As can best be seen in FIG. 6, first slot 132 extends from a first slot opening 146 at a first slot first end 148 to a rail hole 150 at a first slot second end 152. First slot second end 152 opposes first slot first end 148. A first neck portion 170 extends along the length of first slot 132 between opening 146 and rail hole 150. Rail hole 150 is circular in shape in this embodiment, and is sized to encircle first rail 126 of bag holder hook 116. First neck 170 is equal to or slightly smaller than the diameter of first rail 126, so that once first rail 126 is slid into slot 132, first rail 126 is captured in rail hole 150, coupling bagging clip 110 to first rail 126.

Second slot 134 extends from a second slot opening 154 at a second slot first end 156 to a rail hole 158 at a second slot second end 160 of second slot 134. Second slot second end 160 opposes second slot first end 156. A second neck portion 172 extends along the length of second slot 134 between opening 154 and rail hole 158. Rail hole 158 is circular in shape in this embodiment, and is sized to encircle second rail 128 of bag holder hook 116. Second neck 172 is equal to or slightly smaller than the diameter of second rail 128, so that once second rail 128 is slid into slot 134, second rail 128 is captured in rail hole 158, coupling bagging clip 110 to second rail 128.

Bagging clip 110 is coupled to bag holder hook 116 in this embodiment by coupling first slot 132 to first rail 126 and coupling second slot 134 to second rail 128. First slot 132 is coupled to first rail 126 by sliding first rail 126 into first slot 132 until first rail 126 is captured in rail hole 150. Second slot 134 is coupled to second rail 128 by sliding second rail 128 into second slot 134 until second rail 128 is captured in rail hole 158, as shown in FIG. 3. First and second neck portions 170 and 172 keep first rail 126 and second rail 128 captured in first slot 132 and second slot 134, respectively.

Center support 130 is between first and second slots 132 and 134. Center support 130 keeps bagging clip 110 from sliding off end 176 of bag holder hook 116. As bagging clip 110 slides to end 176 of bag holder hook 116, center support 130 hits end 176 of bag holder hook 130, keeping bagging clip 110 from falling off of bag holder hook 116. Center support 130 in this embodiment includes a sloped protrusion 136 that extends from center support 130 (see FIG. 4, FIG. 5 and FIG. 7, for example). Protrusion 136 is a sloped protrusion in this embodiment, but this is not meant to be limiting. Protrusion 136 has a protrusion front surface 164 (see FIG. 4 through FIG. 7). Protrusion front surface 164 of protrusion 136 is sloped such that protrusion front surface 164 lies in a protrusion plane 186 that is not parallel to a disk plane 188 of disk front surface 166, as shown in FIG. 7. An angle 178 is between protrusion plane 186 and disk plane 188. In this embodiment angle 178 is about 15 degrees. In some embodiments, angle 178 is between 10 degrees and 20 degrees. An angle 178 of between 10 and 20 degrees provides the optimum shape of protrusion 136 so that protrusion 136 catches end 176 of bag holder hook 116. The sloped shape of protrusion 136 helps center support 130 catch and hold end 176 of bag holder hook 116 and keep bagging clip 110 coupled to bag holder hook 116.

In some embodiments, bagging clip 110 includes strap 140, as shown in FIG. 5. Strap 140 in this embodiment is coupled to disk 142 through a strap hole 138. Strap 140 is used to couple bagging clip 110 to bagging station 112 so that bagging clip 110 does not get misplaced, lost, or stolen. Strap 140 can couple to bagging station 112, to bag holder 114, or to bag holder hook 116, for example, but not by way of limitation. Strap 140 can be a wire, a rope, a string, a strap, a cord, or any other elongate element that can couple bagging clip 110 to bagging station 112.

Figure 8:
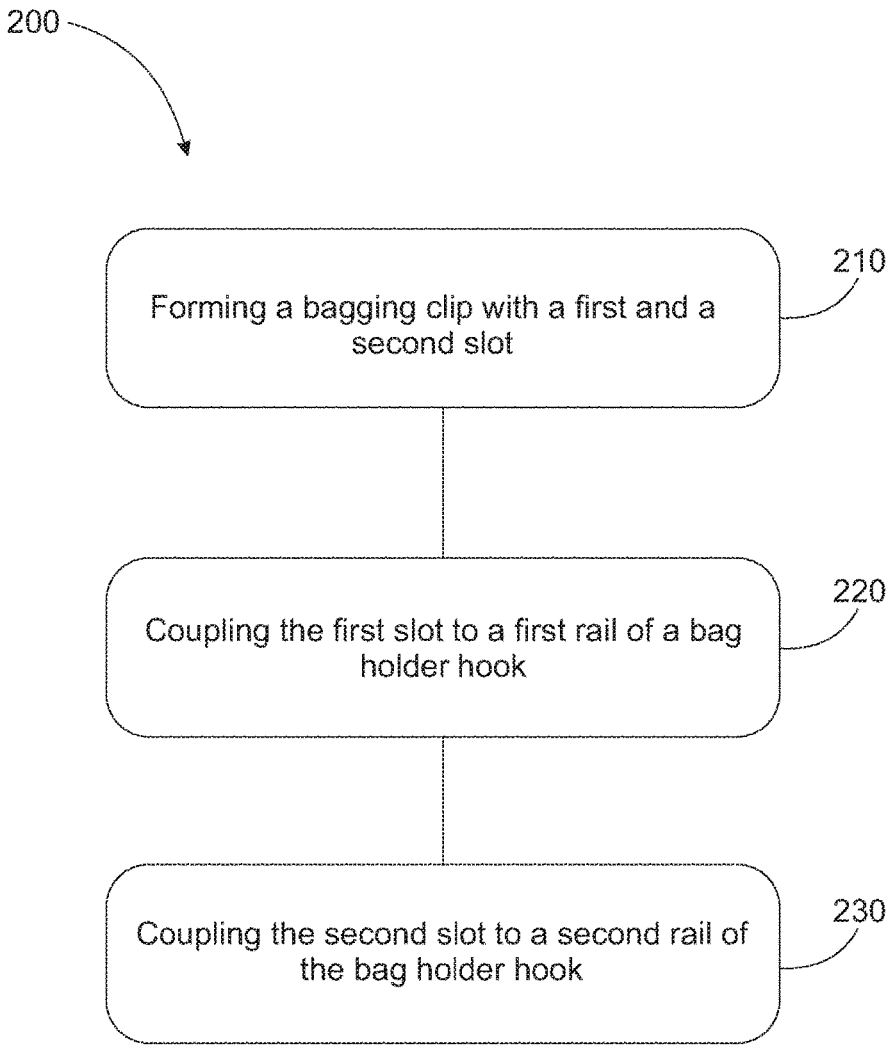
FIG. 8 illustrates a method of keeping a plurality of shopping bags on a bag holder hook of a bagging station

FIG. 8 illustrates a method 200 of keeping a plurality of shopping bags on a bag holder hook of a bagging station. Method 200 includes an act 210 of forming a bagging clip comprising a first and a second slot. Method 200 also includes an act 220 of coupling the first slot to a first rail of the bag holder hook of a bag holder. And method 200 includes an act 230 of coupling the second slot to a second rail of the bag holder hook. Method 200 can include many other acts. In some embodiments, method 200 includes coupling a strap to the bagging clip and to the bag holder. In some embodiments, method 200 includes coupling the bagging clip to the bagging station with a strap.

FIG. 9 through FIG. 13 shows an embodiment of bagging clip 210. Bagging clip 210 is similar to bagging clip 110, except bagging clip 210 has only one slot for coupling to a rail of a bag holder hook. FIG. 9 shows a close-up front perspective view of bag holder 214 with bag holder hook 216, with two bagging clips 210 coupled to bag holder hook 216. Bagging clips 210 keep plurality of shopping bags 220 (FIG. 1) from sliding off, being pulled off, or falling off of, bag holder hook 216 as an individual one of plurality of shopping bags 220 is opened, filled, or removed from bag holder hook 216. Bagging clips 210 allow one at a time of plurality of shopping bags 220 to be opened and removed, while keeping the remaining shopping bags hanging from bag holder hook 216. Bagging clip 210 is used with bag holder hook 216 because the parallel rails 226 and 228 (FIG. 9) of bag holder hook 216 are too far apart for bagging clip 110 to be coupled to both rail 226 and 228 simultaneously. In this embodiment, rails 226 and 228 are about 1 inch apart, but this is not meant to be limiting. In the embodiment of bagging clip 210 shown in FIG. 1 and FIG. 9 through FIG. 13, two bagging clips 210 are used, as shown in FIG. 9, to keep plurality of shopping bags 220 from coming off of bag holder hook 216. One bagging clip 210 is coupled to rail 226, and one bagging clip 210 is coupled to rail 228, as shown in FIG. 1 and FIG. 9. In some embodiments, only one bagging clip 210 is used to hold plurality of bags 220 on bag holder hook 216.

Figure 10:
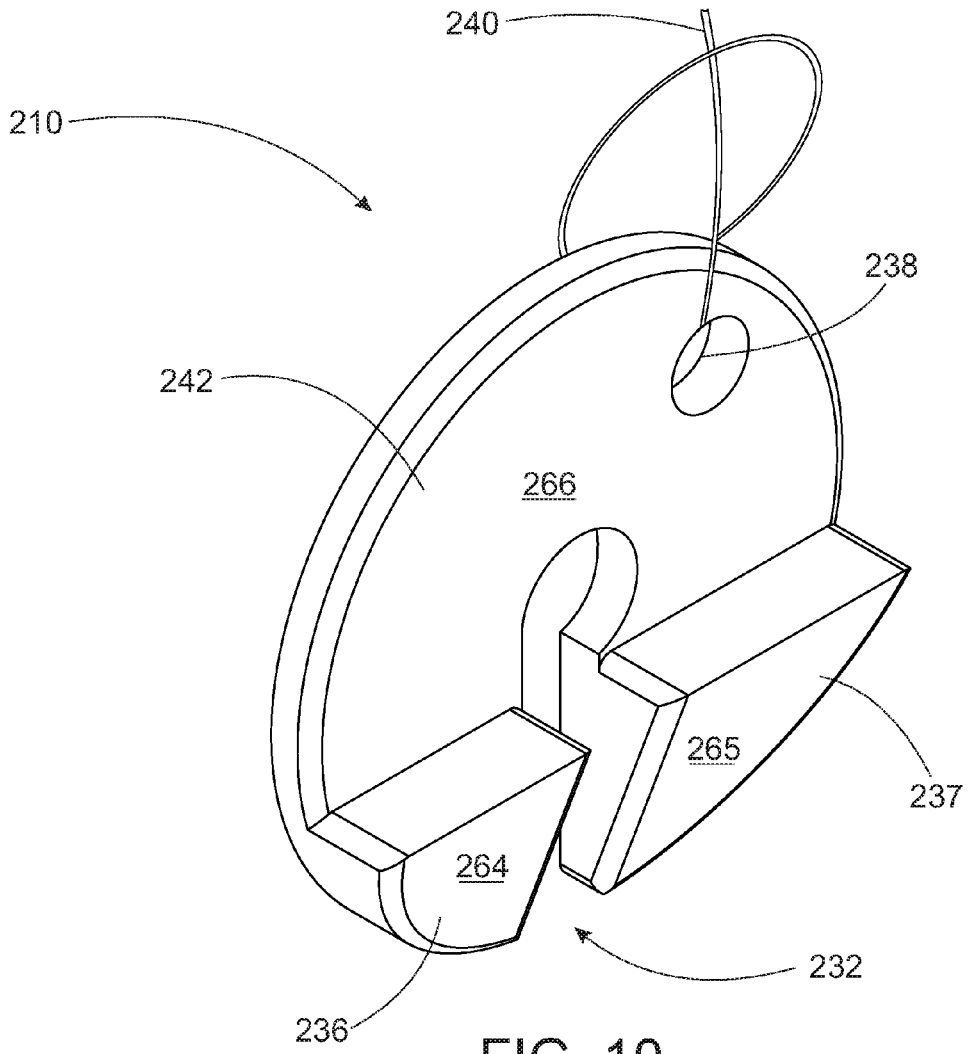
FIG. 10 shows a front perspective view of a further embodiment of a bagging clip.
Figure 11:
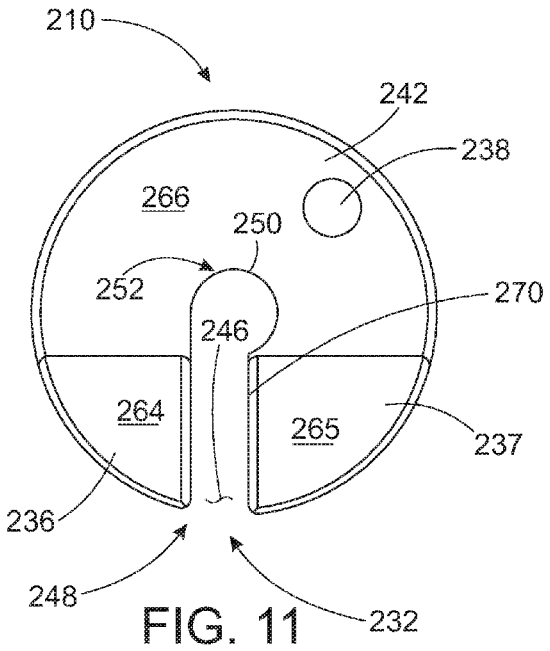
FIG. 11 shows a front view of the bagging clip of FIG. 10.
Figure 12:
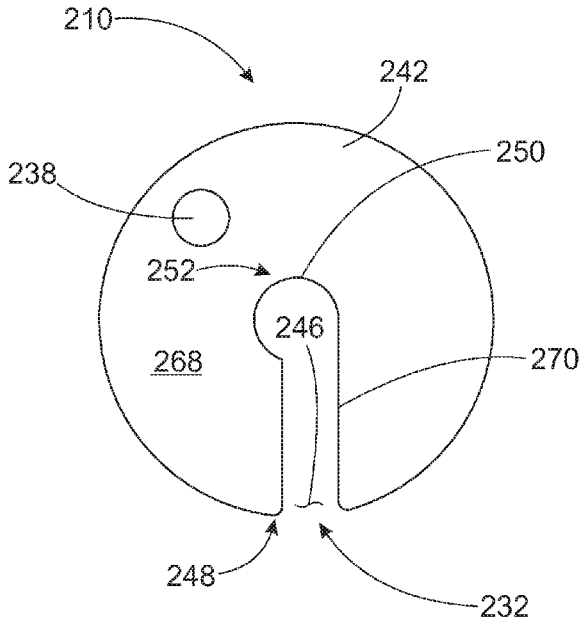
FIG. 12 shows a rear view of the bagging clip of FIG. 10.
Figure 13:
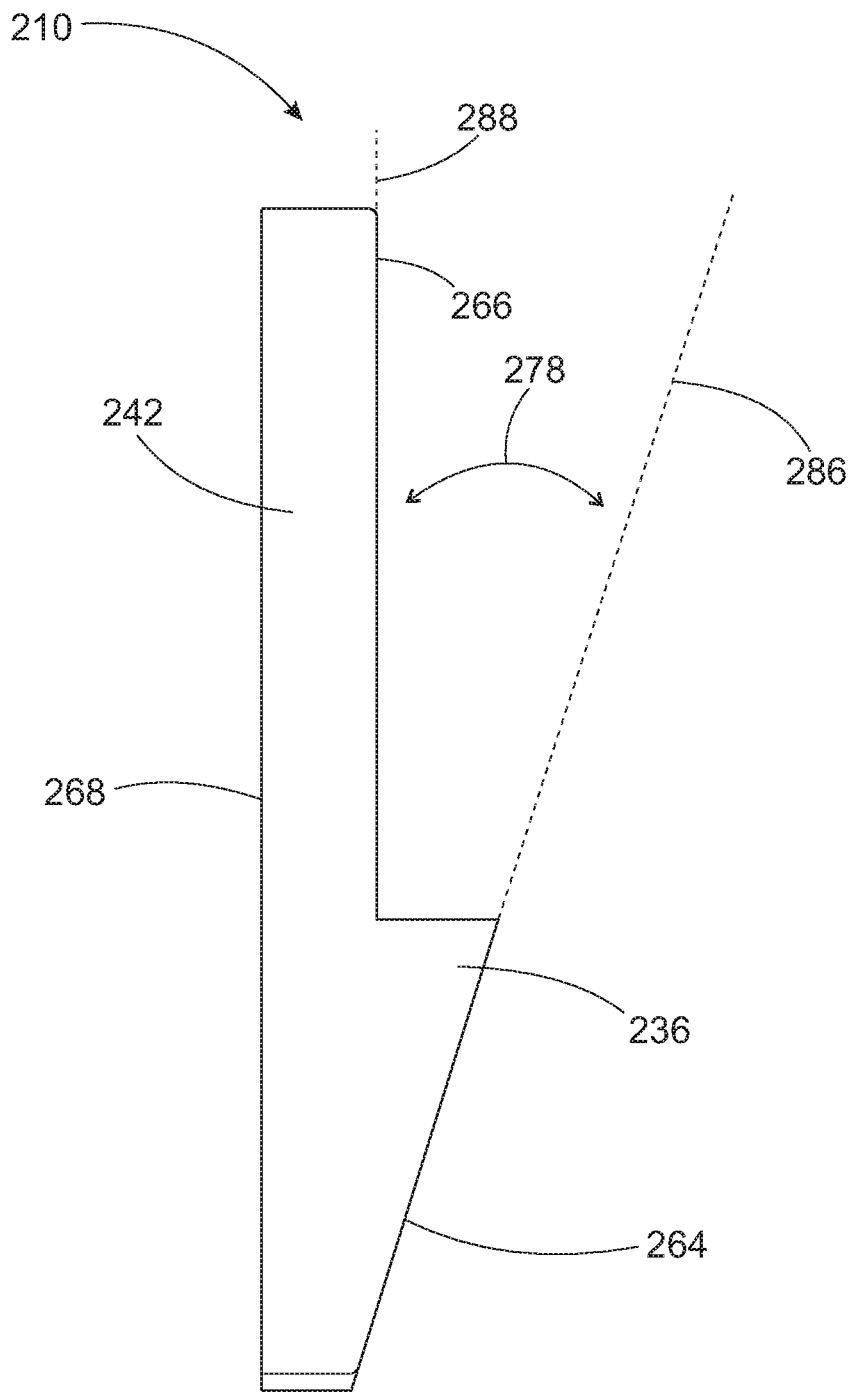
FIG. 13 shows a side view of the bagging clip of FIG. 10.

FIG. 10 through FIG. 13 show additional details of bagging clip 210. FIG. 10 shows a front perspective view of bagging clip 210. FIG. 11 shows a front view of bagging clip 210. FIG. 12 shows a rear view of bagging clip 210. FIG. 13 shows a side view of bagging clip 210.

Bagging clip 210 is formed of a plate, which in this embodiment is in the shape of a disk 242. It is to be understood that the plate forming bagging clip 210 can be many other shapes and configurations other than a disk. Disk 242 includes a slot 232 in disk 242. Slot 232 couples disk 242 to a rail of bag holder hook 216, as shown in FIG. 9. Slot 232 is the means to couple disk 242 to bag holder hook 216 of shopping bag holder 214. Slot 232 is configured to couple bagging clip 210 to rail 226 or 228 of shopping bag holder 214.

Bag holder hook 216, in the embodiment shown in FIG. 1 and FIG. 9, is formed in part of a number of metal rails (also known as rods or a bars), and includes a first rail 226 and a second rail 228 (see FIG. 9). First rail 226 and second rail 228 are parallel to each other in this embodiment, and are coupled together at an end 276 of bag holder hook 216. In this embodiment, first rail 226 and second rail 228 are about 1 inch apart, which is too far apart for a bagging clip 110 to be able to couple to both first rail 226 and second rail 228. In this embodiment, one bagging clip 210 couples to first rail 226 and one bagging clip 210 couples to second rail 228. Slot 232 is a means to couple disk 242 of bagging clip 210 to first rail 226 of bag holder hook 216, and slot 232 is a means to couple disk 242 of bagging clip 210 to second rail 228 of bag holder hook 216. It is to be understood that bag holder hook 216 can take many other forms, and the means to couple disk 242 of bagging clip 210 to bag holder hook 216 can take many different forms other than slot 232.

Slot 232 is a cutout in disk 242 (see FIG. 10 through FIG. 13). The cutout extends all the way through disk 242, from a disk front surface 266 to a disk back surface 268 of disk 242.

As can best be seen in FIG. 11 and FIG. 12, slot 232 extends from a slot opening 246 at a slot first end 248 to a rail hole 250 at a slot second end 252. Slot second end 252 opposes slot first end 248. A neck portion 270 extends along the length of slot 232 between opening 246 and rail hole 250. Rail hole 250 is circular in shape in this embodiment, and is sized to encircle rail 226 or rail 228 of bag holder hook 216. Neck portion 270 is equal to or slightly smaller than the diameter of rail 226 or 228, so that once rail 226 or rail 228 is slid into slot 232, rail 226 or 228 is captured in rail hole 250, coupling bagging clip 210 to rail 226 or rail 228.

Bagging clip 210 is coupled to bag holder hook 216 in this embodiment by sliding rail 226 or rail 228 into slot 232 until rail 226 or 228 is captured in rail hole 250, as shown in FIG. 9. Neck portion 270 keeps rail 226 or 228 captured in slot 232.

Bagging clip 210 includes a first protrusion 236 and a second protrusion 237, as shown in FIG. 10, FIG. 11, and FIG. 13. First and second protrusion 236 and 237 are protrusions extending from front surface 266 of bagging clip 210. First and second protrusion 236 and 237 are on opposing sides of slot 232. First and second protrusion 236 and 237 are used to help bagging clip 210 stay on bag holder hook 216. First and second protrusion 236 and 237 grab onto end 276 when bagging clip 210 slides to end 276 of bag holder hook 216, helping to keep bagging clip 210 in place on bag holder hook 216. Protrusion 236 and 237 are both sloped protrusions in this embodiment. First protrusion 236 has a first protrusion front surface 264, and second protrusion 237 has a second protrusion front surface 265 (see FIG. 10, FIG. 11, and FIG. 13). First protrusion front surface 264 is sloped, and second protrusion front surface 265 is sloped. First protrusion front surface 264 and second protrusion front surface 265 both lie in a protrusion plane 286 that is not parallel to a disk plane 288 of front surface 266 of disk 242, as shown in FIG. 13. Angle 278 is the angle between protrusion plane 286 and disk plane 288. In this embodiment, angle 278 is about 25 degrees, which provides sloped protrusions 264 and 265 which easily grab end 276 of bag holder hook 216. In some embodiments, angle 278 is between 10 degrees and 30 degrees, which provides for protrusions 264 and 265 which grab onto end 276 but do not extend too far from front surface 266 or make the shape of bagging clip 210 unwieldy. The sloped shape of protrusion 236 and 237 helps bagging clip 210 catch and hold end 276 of bag holder hook 216 and keep bagging clip 210 coupled to bag holder hook 216.

Bagging clip 210 includes a strap 240, as shown in FIG. 10. Strap 240 in this embodiment is coupled to disk 242 through a strap hole 238. Strap 240 is used to couple bagging clip 210 to bagging station 212 so that bagging clip 210 does not get misplaced, lost, or stolen. Strap 240 can couple to bagging station 212, to bag holder 214, or to bag holder hook 216, for example, but not by way of limitation. Strap 240 can be a wire, a rope, a string, a strap, a cord, or any other elongate element that can couple bagging clip 210 to bagging station 212. In the embodiment shown, strap 240 is an elongate strap of material.

Bagging clips have been shown and described that couple to the bag holder hook of a bag holder at a bagging station. The bagging clips keep a stack of plastic shopping bags that are hung from the bag holder hook from falling off of the bag holder hook when one of the shopping bags are removed. The bagging clips each include a disk with at least one slot. The slot couples to a rail of the bag holder hook. With the bagging clip coupled to the bag holder hook, the plurality of shopping bags remain hung from the bag holder hook when a shopping bag is removed.

Figure 14:
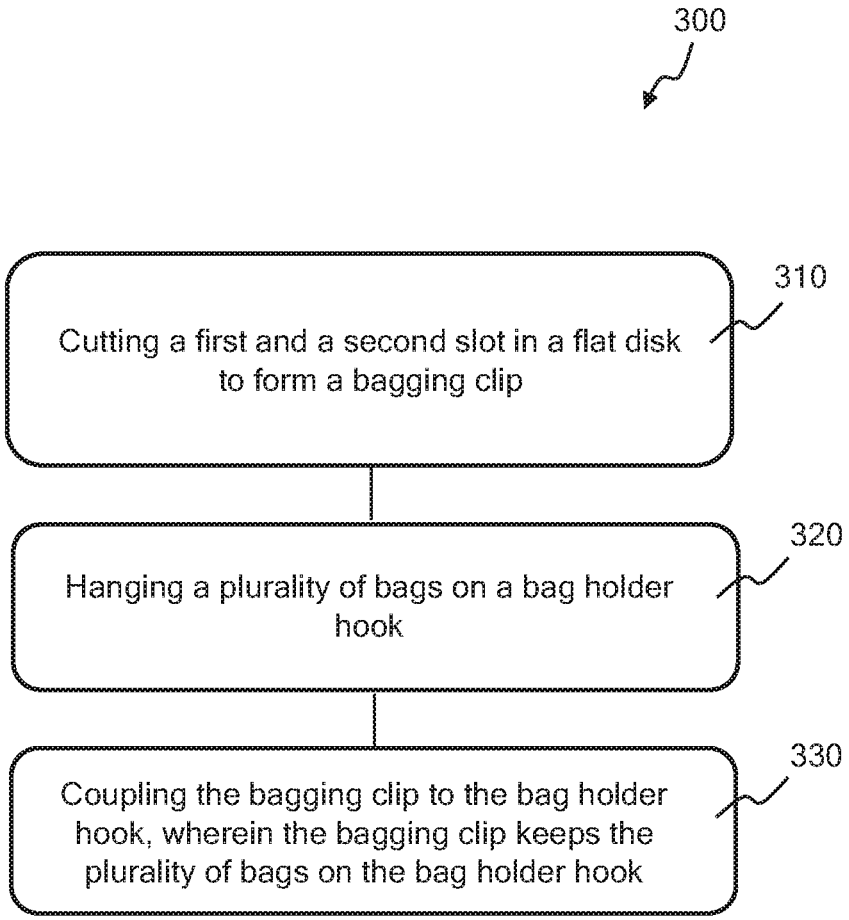
FIG. 14 illustrates a method 300 of keeping a plurality of bags on a bag holder hook of a bagging station.

FIG. 14 illustrates a method 300 of keeping a plurality of bags on a bag holder hook of a bagging station. Method 300 includes an act 310 of cutting a first and a second slot in a flat disk to form a bagging clip. The first and the second slot are parallel to each other in some embodiments. Method 300 also includes an act 320 of hanging the plurality of bags on the bag holder hook, where the bag holder hook comprises a first and a second rail.

Method 300 includes an act 330 of coupling the bagging clip to the bag holder hook, wherein the bagging clip keeps the plurality of bags on the bag holder hook. In some embodiments, act 330 of coupling the bagging clip to the bag holder hook includes coupling the first slot to the first rail of the bagging station. In some embodiments, act 330 of coupling the bagging clip to the bag holder hook includes coupling the second slot to the second rail of the bagging station.

Method 300 can include many other acts. In some embodiments, method 300 includes forming a sloped protrusion on the flat disk, where the sloped protrusion extends from the flat disk between the first and the second slot. In some embodiments, a protrusion front surface lies in a first plane, and a flat disk front surface lies in a second plane, and the first plane and the second plane are not parallel to each other.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A shopping bag bagging station comprising:

a bag holder comprising a bag holder hook; and a bagging clip coupled to the bag holder hook, wherein the bagging clip comprises:

a plate;

a first slot and a second slot in the plate; and a center support defined by the first and the second slot, wherein each of the first and the second slot form an opening on an edge of the plate, and wherein the first slot and the second slot couple the plate to the bag holder hook.

2. The shopping bag bagging station of claim 1, wherein the at least one slot comprises an opening at a first end of the slot and a rail hole at a second end of the slot opposing the first end.

3. The shopping bag bagging station of claim 2, wherein the rail hole is circular in shape, and wherein the bag holder hook slides through the opening and along the slot to the rail hole to couple the bagging clip to the bag holder hook.

4. The shopping bag bagging station of claim 1, wherein:

the bag holder hook comprises a first rail and a second rail;

the first slot couples to the first rail; and the second slot couples to the second rail.

5. The shopping bag bagging station of claim 1, further comprising a sloped protrusion extending from the center support.

6. The shopping bag bagging station of claim 1, wherein the plate is a flat disk.

7. A method of keeping a plurality of bags on a bag holder hook of a bagging station, the method comprising:

cutting a first and a second slot in a flat disk to form a bagging clip, wherein a center support is defined by the first and the second slot, and wherein each of the first and the second slot form an opening on an edge of the flat disk;

hanging the plurality of bags on the bag holder hook, wherein the bag holder hook comprises a first and a second rail;

coupling the bagging clip to the bag holder hook, wherein the bagging clip keeps the plurality of bags on the bag holder hook.

8. The method of claim 7, wherein the coupling the bagging clip to the bag holder hook comprises:

coupling the first slot to the first rail of the bagging station; and coupling the second slot to the second rail of the bagging station.

9. The method of claim 7, further comprising forming a sloped protrusion on the flat disk, wherein the sloped protrusion extends from the flat disk between the first and the second slot, and wherein a protrusion front surface lies in a first plane, and wherein a flat disk front surface lies in a second plane, and wherein the first plane and the second plane are not parallel to each other.

10. The method of claim 7, wherein the first slot and the second slot are parallel to each other.

* * * * *